US010745844B2

(12) United States Patent
Zhu et al.

(10) Patent No.: US 10,745,844 B2
(45) Date of Patent: Aug. 18, 2020

(54) WASHING MACHINE

(71) Applicant: Wuxi Little Swan Electric Co. Ltd., Wuxi (CN)

(72) Inventors: Biao Zhu, Wuxi (CN); Youqun Chen, Wuxi (CN); Pengcheng Xu, Wuxi (CN)

(73) Assignee: WUXI LITTLE SWAN ELETRIC CO., LTD., Wuxi (CN)

( * ) Notice: Subject to any disclaimer, the term of this patent is extended or adjusted under 35 U.S.C. 154(b) by 0 days.

(21) Appl. No.: 15/875,322

(22) Filed: Jan. 19, 2018

(65) Prior Publication Data

US 2018/0142400 A1 May 24, 2018

Related U.S. Application Data

(63) Continuation of application No. PCT/CN2016/090725, filed on Jul. 20, 2016.

(30) Foreign Application Priority Data

Jul. 20, 2015 (CN) ..... 2015 1 0427578
Jul. 20, 2015 (CN) ..... 2015 2 0528424 U

(51) Int. Cl.
*D06F 37/12* (2006.01)
*D06F 37/22* (2006.01)
(Continued)

(52) U.S. Cl.
CPC ..... *D06F 37/225* (2013.01); *D06F 37/145* (2013.01); *D06F 37/264* (2013.01); *D06F 37/265* (2013.01); *D06F 37/245* (2013.01)

(58) Field of Classification Search
CPC ..... D06F 13/00; D06F 17/00; D06F 17/02; D06F 17/06; D06F 23/04; D06F 37/12; D06F 37/14; D06F 37/145; D06F 37/24; D06F 37/245; D06F 37/225; D06F 37/264; D06F 39/083; D06F 21/06; D06F 21/08; D06F 21/14
See application file for complete search history.

(56) References Cited

U.S. PATENT DOCUMENTS 2,149,987 A * 3/1939 Altorfer
2,439,469 A * 4/1948 Husted
(Continued)

FOREIGN PATENT DOCUMENTS

CN 2474560 Y 1/2002
CN 2612699 Y 4/2004
(Continued)

OTHER PUBLICATIONS

Midea, Office Action, CN201510427578.X, dated Apr. 18, 2018, 8 pgs. (No English translation available).
(Continued)

*Primary Examiner* — David G Cormier
(74) *Attorney, Agent, or Firm* — Morgan, Lewis & Bockius LLP

(57) ABSTRACT

A washing machine includes a machine housing, a water accommodation tub disposed in the machine housing; a washing tub assembly disposed in the water accommodation tub and including a washing tub; and a balance ring mounted to an upper end of the washing tub and having a lower end fitted in the washing tub.

12 Claims, 7 Drawing Sheets

(51) Int. Cl.

| | |
|---|---|
| ***D06F 37/14*** | (2006.01) |
| ***D06F 37/26*** | (2006.01) |
| *D06F 37/24* | (2006.01) |

(56) References Cited

U.S. PATENT DOCUMENTS

| | | | | |
|---|---|---|---|---|
| 2,973,637 | A * | 3/1961 | Sisson | D06F 37/00 68/18 D |
| 4,483,161 | A * | 11/1984 | Oida | D06F 23/04 68/23.6 |
| 2004/0040346 | A1 * | 3/2004 | Hawkins | D06F 37/14 68/174 |

FOREIGN PATENT DOCUMENTS

| | | | |
|---|---|---|---|
| CN | 2612700 | Y | 4/2004 |
| CN | 2612702 | Y | 4/2004 |
| CN | 101173435 | A | 5/2008 |
| CN | 203855826 | U | 10/2014 |
| CN | 203977154 | U | 12/2014 |
| CN | 204401311 | U | 6/2015 |
| CN | 204434979 | U | 7/2015 |
| CN | 205024467 | U | 2/2016 |
| CN | 205115863 | U | 3/2016 |
| JP | S50-111977 | U | 9/1975 |
| JP | S61265190 | A | 11/1986 |
| JP | 9-220395 | A | 8/1997 |
| JP | H09-220395 | A | 8/1997 |
| JP | H11-90084 | A | 4/1999 |
| JP | 2000-271379 | A | 10/2000 |
| JP | 2003103086 | A | 4/2003 |
| JP | 2005-525888 | A | 9/2005 |
| JP | S50-35752 | A | 9/2012 |
| JP | 2012-187183 | A | 10/2012 |
| JP | 2012-187200 | A | 10/2012 |
| JP | 2014012061 | A | 1/2014 |
| JP | 2015-033512 | A | 2/2015 |

OTHER PUBLICATIONS

Midea, International Search Report and Written Opinion, PCT/CN2016090725, dated Oct. 14, 2016, 24 pgs.

Midea, Notice of Reasons for Refusal, JP 2018-522841, dated Mar. 19, 2019, 19 pgs.

Midea, Office Action, CN201510427578.X, dated Aug. 21, 2017, 9 pgs. (No English translation available).

Notice of Reasons for Refusal, JP 2018-522841, dated Jan. 27, 2020, 18 pgs.

Wuxi Little Swan Co. Ltd., Office Action, BR112018001210-6, dated Jan. 6, 2020, 6 pgs.

* cited by examiner

WASHING MACHINE

PRIORITY CLAIM AND RELATED APPLICATION

This application is a continuation application of PCT/CN2016/090725, entitled "WASHING MACHINE" filed on Jul. 20, 2016, which claims priority to Chinese Patent Application No. 201510427578.X, filed with the State Intellectual Property Office of the People's Republic of China on Jul. 20, 2015 and Chinese Patent Application No. 201520528424.5, filed with the State intellectual Property Office of the People's Republic of China on Jul. 20, 2015, respectively, all of which are incorporated herein by reference in their entirety.

FIELD OF THE INVENTION

The present disclosure relates to a field of household appliances, and more particularly to a washing machine.

BACKGROUND

In a conventional impeller washing machine, water levels of inner tub and outer tub are the same during the washing, such that the inner tub and the outer tub need to be filled with washing water, thus a relatively large amount of washing water is required. However, the water between the inner tub and the outer tub does not involve in the washing, and only the water in the inner tub actually involves in the washing, such that water resources are wasted. Furthermore, the excessive water between the inner tub and the outer tub will also reduce a concentration of detergent, such that a larger amount of detergent needs to be put in to achieve a good washing effect, which undoubtedly also causes a waste of the detergent.

In order to further improve water saving performance, a washing machine with a holeless inner tub exists in the related art, in which the inner tub is configured as a holeless stainless steel tub, such that a water level difference is formed between the inner tub and the outer tub, and the washing water can be saved. Meanwhile, this washing machine is provided with a water outlet passage above the inner tub, and the washing water flows upwardly along a wall of the inner tub and is discharged via the water outlet passage under the action of a centrifugal force during dehydration, thereby achieving a purpose of discharging the water.

However, when this washing machine is discharging the water, a relatively large centrifugal force needs to be produced by an electric motor to realize the water discharge. Therefore, this washing machine needs to employ a high-power electric motor, which is adverse to saving electric power and controlling noise and vibration.

SUMMARY

Embodiments of the present disclosure seek to solve at least one of the problems existing in the related art. To this end, an objective of the present disclosure is to provide a washing machine, which can still reduce washing water consumption and at least has a dynamic water saving effect when a relatively low-power electric motor is employed.

The washing machine according to some embodiments of the present disclosure, includes a machine housing; a water accommodation tub disposed in the machine housing; a washing tub assembly disposed in the water accommodation tub and including a washing tub; and a balance ring mounted to an upper end of the washing tub and having a lower end fitted in the washing tub, the balance ring and the washing tub defining a water outlet passage therebetween, and the water outlet passage being configured to discharge water in the washing tub.

Compared with a conventional technology, in the washing machine according to some embodiments of the present disclosure, the water outlet passage is defined between the balance ring and the washing tub, and the high-speed rotation of the washing tub in the dehydration process will discharge the water in the washing tub out of the washing tub via the water outlet passage, thereby completing the dehydration process.

Additionally, the washing machine according to above embodiments of the present disclosure may further have the following additional technical features.

In some embodiments of the present disclosure, the washing tub assembly includes at least one cover plate of a water-returning cover plate and a waterfall-spraying cover plate, and after the at least one cover plate is mounted to the washing tub, there are no holes in a visible area inside the washing tub when viewed from inside.

Further, the washing tub also includes at least one cover plate mounting hole of a water-returning cover plate mounting hole and a waterfall-spraying cover plate mounting hole, the water-returning cover plate mounting hole is configured to mount to the water-returning cover plate, and the waterfall-spraying cover plate mounting hole is configured to mount to the waterfall-spraying cover plate.

In some embodiments of the present disclosure, the washing tub assembly includes a tub bottom, and after the tub bottom is mounted to the washing tub, there are no holes in the visible area inside the washing tub when viewed from inside.

Further, the washing tub includes a tub bottom mounting hole configured to mount to the tub bottom.

In some embodiments of the present disclosure, the washing tub assembly includes the balance ring, and after the balance ring is mounted to the washing tub, there are no holes in the visible area inside the washing tub when viewed from inside.

In some embodiments of the present disclosure, the washing tub includes a balance ring mounting hole configured to mount to the balance ring.

In some embodiments of the present disclosure, a wall of the washing tub defines a water leakage hole configured to discharge the water in the washing tub.

Further, a plurality of water leakage holes are provided at a lower portion of the washing tub.

In some embodiments of the present disclosure, the lower portion of the washing tub is provided with a reinforcing rib, and the water leakage hole is disposed below the reinforcing rib.

In some embodiments of the present disclosure, a plurality of water leakage holes are provided at the lower portion of the washing tub, and after the tub bottom is mounted to the washing tub, the water leakage holes are covered by the tub bottom when viewed from inside.

In some embodiments of the present disclosure, an inner wall of the washing tub is provided with a pattern area; an area between a circle passing through an upper edge of the pattern area with a center of the washing tub as a circle center and a circle passing through a lower edge of the pattern area with the center of the washing tub as a circle center is a central area. of the washing tub; and the pattern area of the washing tub has no holes.

Further, a plurality of pattern areas are provided and spaced apart from one another in a circumferential direction of the washing tub, and each pattern area is arranged in a rectangular shape on the wall of the washing tub.

In some embodiments of the present disclosure, an outer wall of the balance ring defines a recess recessed inwardly and extending in an axial direction of the balance ring, the recess extends upwardly from a lower end surface of the balance ring beyond an upper end surface of the washing tub, and an inner wall of the washing tub and the recess define the water outlet passage.

In some embodiments of the present disclosure, a bottom wall of the recess extends obliquely and outwardly in a direction from bottom to top.

In some embodiments of the present disclosure, a plurality of water outlet passages are provided and arranged in the circumferential direction of the washing tub.

Further, a circumferential wall of the washing tub is provided with the water leakage hole communicating an interior of the washing tub and an exterior of the washing tub, and the water leakage hole is located below the central area and adjacent to a lower end of the washing tub.

In some embodiments of the present disclosure, an upper end of the tub bottom is fitted in the lower end of the washing tub, and the water leakage hole of the washing tub is covered by a part of the tub bottom fitted in the washing tub.

In some embodiments of the present disclosure, the number of the water leakage holes ranges from 24 to 40. Further, the number of the water leakage holes is 28.

In some embodiments of the present disclosure, the circumferential wall of the washing tub is provided with the water leakage hole, a tub bottom positioning hole configured to position the tub bottom, and a tub bottom mounting hole configured to mount to the tub bottom, the tub bottom mounting hole and the tub bottom positioning hole are located below the water leakage hole and covered by the part of the tub bottom fitted in the washing tub.

Further, the washing tub is provided with at least one cover plate of the water-returning cover plate and the waterfall-spraying cover plate, the wall of the washing tub defines the cover plate mounting hole, and the at least one cover plate is mounted to the circumferential wall of the washing tub.

In some embodiments of the present disclosure, the washing tub assembly further includes the tub bottom.

In some embodiments of the present disclosure, the wall of the washing tub defines an upper mold positioning hole and a lower mold positioning hole, the upper mold positioning hole is located above the central area of the washing tub, the lower mold positioning hole is located below the central area of the washing tub, the upper mold positioning hole is covered by the cover plate, and the lower mold positioning hole is covered by the tub bottom.

In some embodiments of the present disclosure, the washing tub is rotated about a vertical axis to perform washing.

Further, the washing tub assembly includes the washing tub, and an impeller is disposed at a bottom center of the washing tub assembly.

Figure 1:
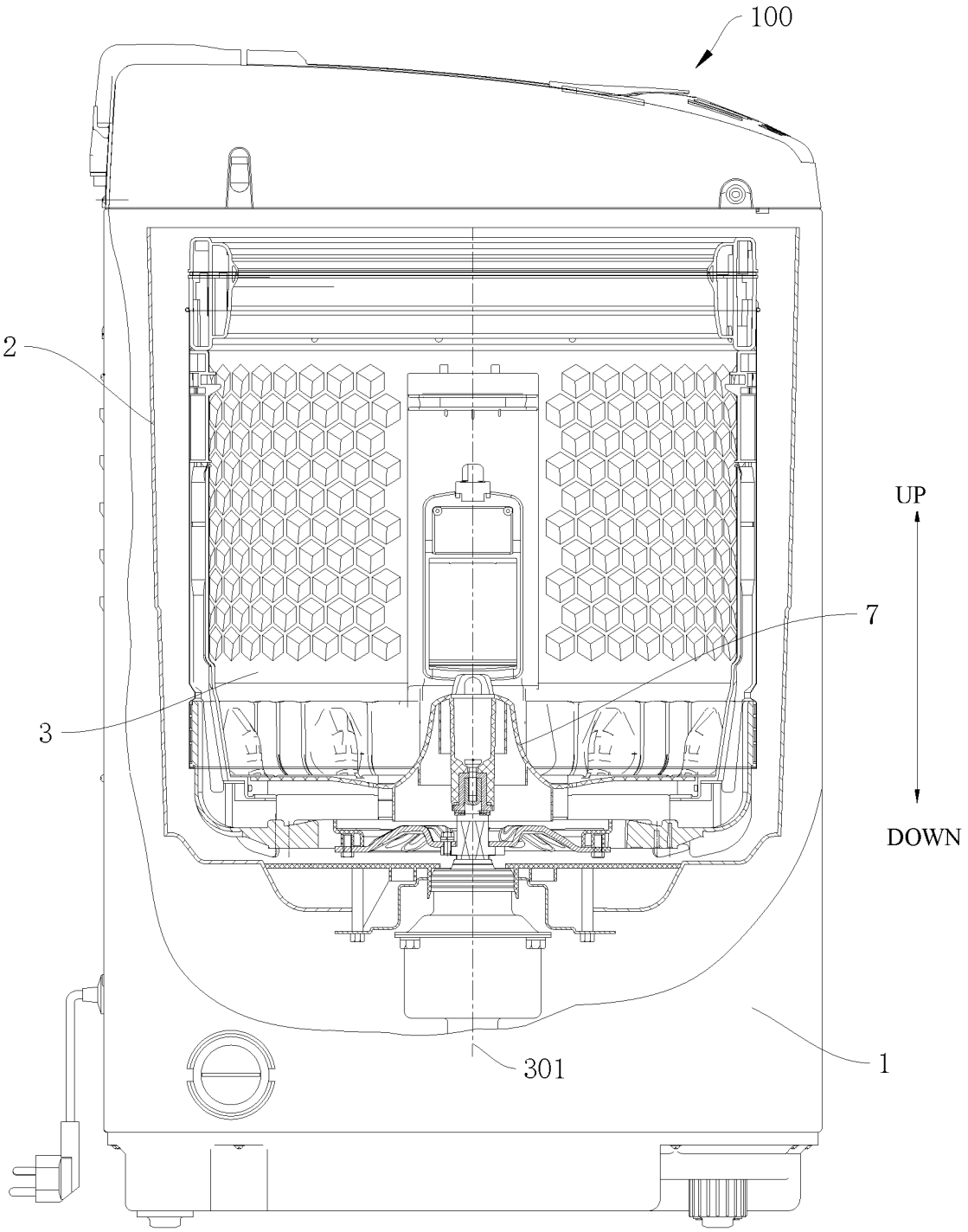
FIG. 1 is a partial sectional view of a washing machine according to some embodiments of the present disclosure.

Referemce numeral: washing machine 100, water outlet passage 101, central area 102, recess 103, water leakage hole 104, tub bottom positioning hole 105, tub bottom mounting hole 106, cover plate mounting hole 107, upper mold positioning hole 108, lower mold positioning hole 109, machine housing 1, water accommodation tub 2, washing tub assembly 3, balance ring 4, water-returning cover plate 5, waterfall-spraying cover plate 6, impeller 7, washing tub 31, tub bottom 32, pattern area 311, flanging 312, reinforcing rib 313, boss 41, and vertical axis 301.

DETAILED DESCRIPTION

Embodiments of the present disclosure will be described in detail and examples of the embodiments will be illustrated in the drawings, where same or similar reference numerals are used to indicate same or similar members or members with same or similar functions. The embodiments described herein with reference to drawings are explanatory, illustrative, and used to generally understand the present disclosure. The embodiments shall not be construed to limit the present disclosure.

In the present disclosure, unless specified or limited otherwise, the terms "mounted," "connected," "coupled," "fixed" and the like are used broadly, and may be, for example, fixed connections, detachable connections, or integral connections; may also be mechanical connections; may also be direct connections or indirect connections via intervening structures; may also be inner communications or interaction of two elements. The above terms can be understood by those skilled in the art according to specific situations.

Furthermore, a first feature "on," "above," or "on top of" a second feature may include an embodiment in which the first feature is right "on," "above," or "on top of" the second feature, and may also include an embodiment in which the first feature is not right "on," "above," or "on top of" the second feature, or just means that the first feature has a sea level elevation larger than the sea level elevation of the second feature. While first feature "beneath," "below," or "on bottom of" a second feature may include an embodiment in which the first feature is right "beneath," "below," or "on bottom of" the second feature, and may also include an embodiment in which the first feature is not right "beneath," "below," or "on bottom of" the second feature, or just means that the first feature has a sea level elevation smaller than the sea level elevation of the second feature.

A washing machine 100 according to some embodiments of the present disclosure will be described in detail in the following with reference to accompanying drawings.

In combination with FIGS. 1 to 7, the washing machine 100 according to some embodiments of the present disclosure includes a machine housing 1, a water accommodation tub 2, a washing tub assembly 3, and a balance ring 4.

Specifically, the water accommodation tub 2 is disposed in the machine housing 1, the washing tub assembly 3 is disposed in the water accommodation tub 2, and the washing tub assembly 3 includes a washing tub 31. The balance ring 4 is mounted to an upper end of the washing tub 31 and has a lower end fitted in the washing tub 31, the balance ring 4 and the washing tub 31 define a water outlet passage 101 therebetween, and the water outlet passage 101 is configured to discharge water in the washing tub 31. In a dehydration process of the washing machine 100, high-speed rotation of the washing tub 31 generates a centrifugal force to discharge the water in the washing tub 31 and moisture in clothes or the like mainly via the water outlet passage 101.

Compared with the conventional technology, in the washing machine 100 according to some embodiments of the present disclosure, the water outlet passage 101 is defined between the balance ring 4 and the washing tub 31, and the high-speed rotation of the washing tub 31 in the dehydration process will discharge the water in the washing tub 31 out of the washing tub 31 mainly via the water outlet passage 101, thereby completing the dehydration process.

Additionally, since the water in the washing tub assembly 3 can be discharged out of the washing tub assembly 3 through the water outlet passage 101, the washing tub assembly 3 does not need to be provided with dehydration holes or the dehydration holes can be reduced, and the most part of water injected into the washing tub assembly 3 is configured to wash the clothes. During the washing, a water level in an inner tub is higher than a water level in an outer tub, thereby achieving a dynamic water saving effect.

Therefore, the washing machine 100 of the present application maintains a dehydration function of a conventional washing machine, and also reduces water consumption of the washing machine 100, thereby achieving a purpose of saving water.

Figure 2:
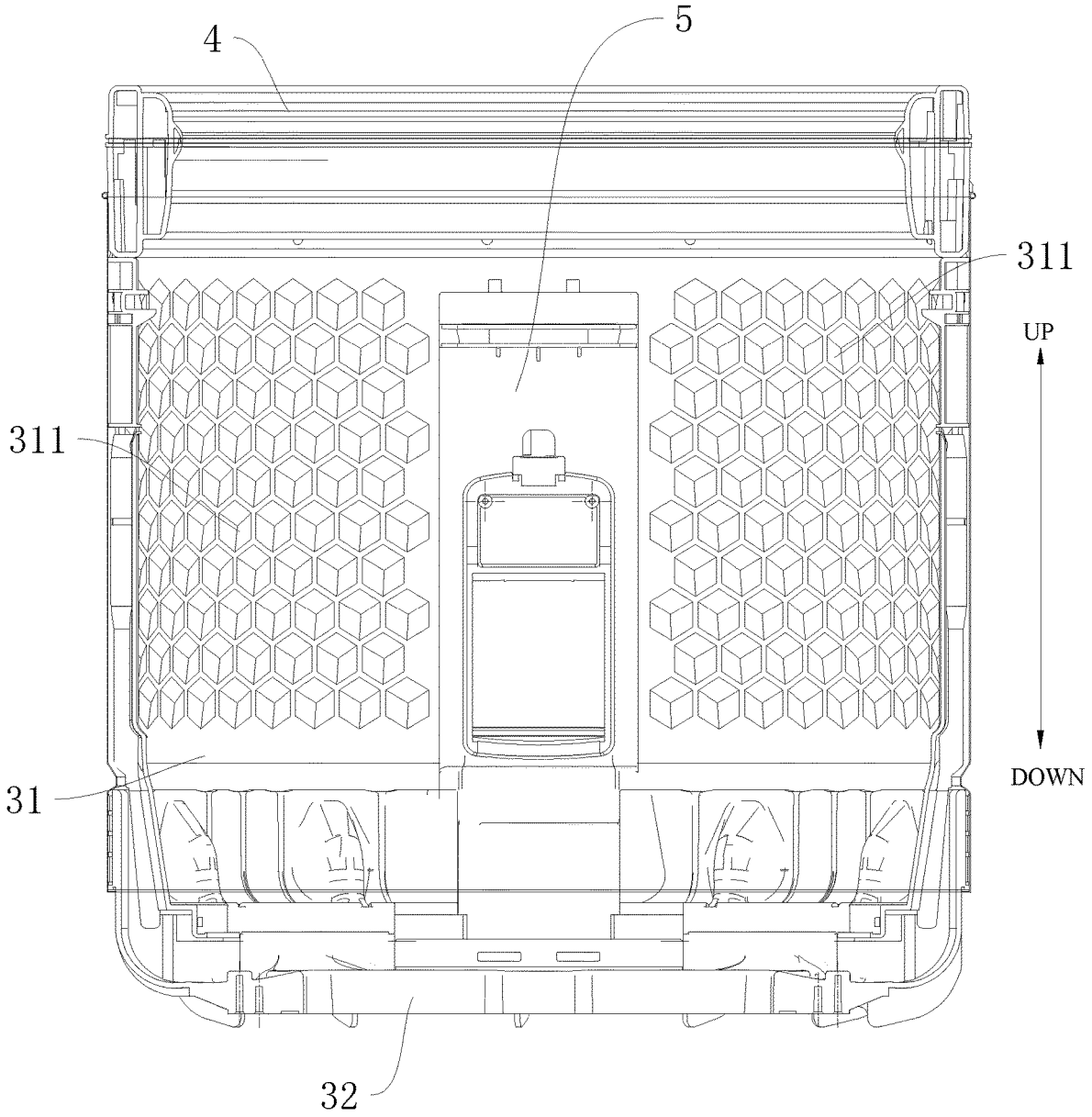
FIG. 2 is a schematic view of a washing tub assembly of a washing machine according to some embodiments of the present disclosure.
Figure 3:
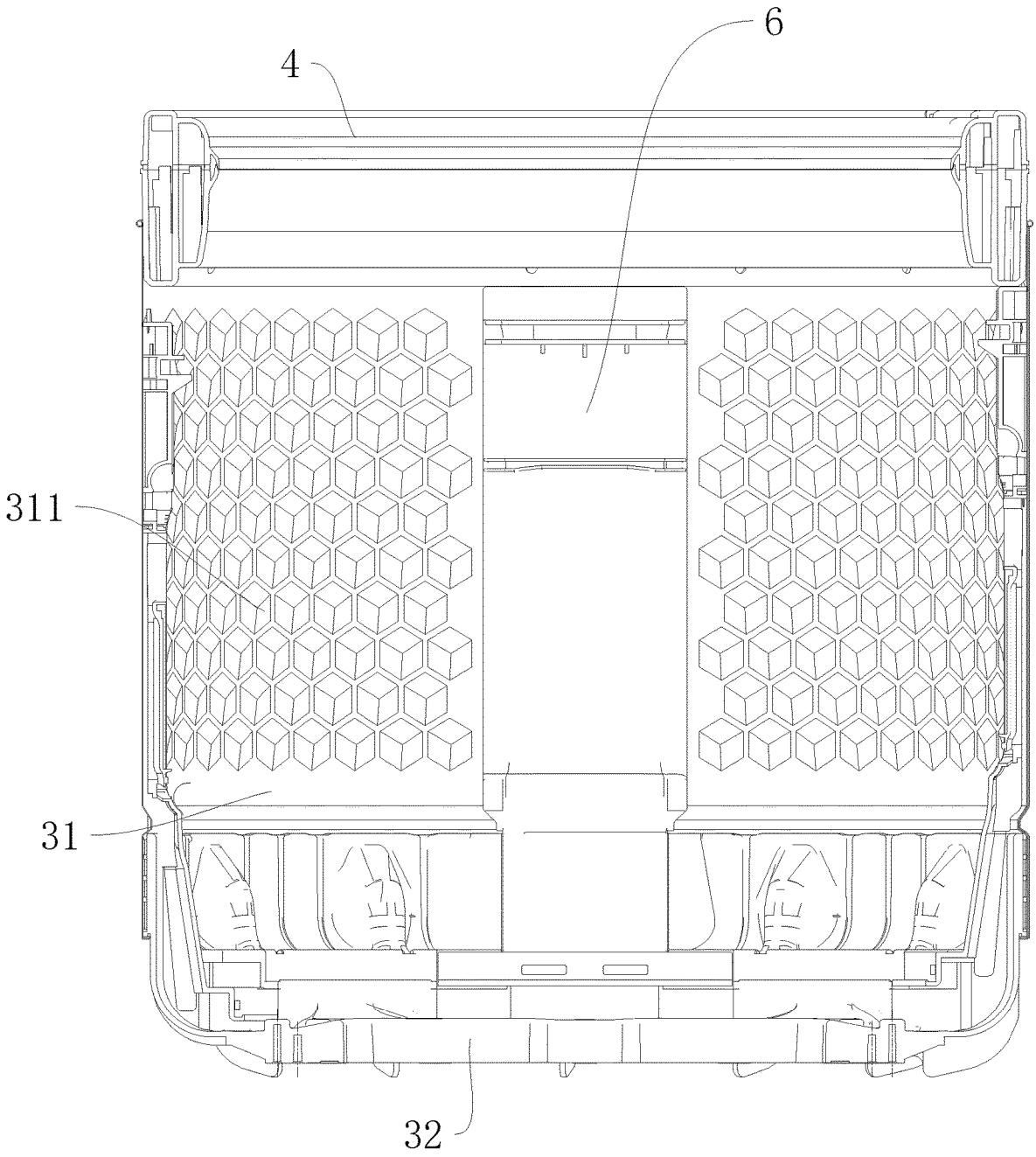
FIG. 3 is another schematic view of a washing tub assembly of a washing machine according to some embodiments of the present disclosure.

Referring to FIGS. 2 and 3, in some embodiments of the present disclosure, the washing tub assembly 3 includes at least one cover plate of a water-returning cover plate 5 and a waterfall-spraying cover plate 6, and after the at least one cover plate is mounted to the washing tub 31, there are no holes in a visible area inside the washing tub when viewed from inside. Therefore, the washing machine 100 has a high-end and elegant appearance, and is water-saving and environment-friendly.

Additionally, the washing tub 31 also includes at least one cover plate mounting hole 107 of a water-returning cover plate mounting hole and a waterfall-spraying cover plate mounting hole, the water-returning cover plate mounting hole is configured to mount to the water-returning cover plate 5, and the waterfall-spraying cover plate mounting hole is configured to mount to the waterfall-spraying cover plate 6.

Specifically, when the water-returning cover plate needs to be mounted on the washing tub 31, the water-returning cover plate mounting hole can be provided on the washing tub 31, and the water-returning cover plate mounting hole is configured to mount to the water-returning cover plate; when the waterfall-spraying cover plate needs to be mounted on the washing tub 31, the waterfall-spraying cover plate mounting hole can be provided on the washing tub 31, and the waterfall-spraying cover plate mounting hole is configured to mount to the waterfall-spraying cover plate; when the water-returning cover plate and the waterfall-spraying cover plate need to be mounted on the washing tub 31, the water-returning cover plate mounting hole and the waterfall-spraying cover plate mounting hole can be provided on the washing tub 31, the water-returning cover plate mounting hole is configured to mount to the water-returning cover plate, and the waterfall-spraying cover plate mounting hole is configured to mount to the waterfall-spraying cover plate.

Additionally, when the cover plate (at least one cover plate of the water-returning cover plate 5 and the waterfall-spraying cover plate 6) has been mounted, the mounting hole configured to mount the cover plate is covered. In short, after the mounting is completed, there are no holes in the visible area inside the washing tub when viewed from inside.

In other words, the washing tub 31 is provided with at least one cover plate of the water-returning cover plate and the waterfall-spraying cover plate, a wall of the washing tub 31 defines a cover plate mounting hole, and the at least one cover plate is mounted to a circumferential wall of the washing tub 31. Specifically, when the washing tub 31 is provided with the water-returning cover plate 5, the water-returning cover plate 5 is mounted to the circumferential wall of the washing tub 31, and the hole configured to mount to the water-returning cover plate is covered after the water-returning cover plate 5 has been mounted; when the washing tub 31 is provided with the waterfall-spraying cover plate 6, the waterfall-spraying cover plate 6 is mounted to the circumferential wall of the washing tub 31, and the hole configured to mount to the waterfall-spraying cover plate 6 is covered after the waterfall-spraying cover plate 6 has been mounted.

After the cover plate (at least one of the water-returning cover plate and the waterfall-spraying cover plate) has been mounted, the corresponding mounting hole is covered. In short, after the mounting is completed, there are no holes in the visible area inside the washing tub 31 when viewed from inside.

Additionally, in some other embodiments of the present disclosure, either of the water-returning cover plate and the waterfall-spraying cover plate can be mounted to the washing tub 31 by riveting or welding, or can be integrally formed with the washing tub 31.

Figure 4:
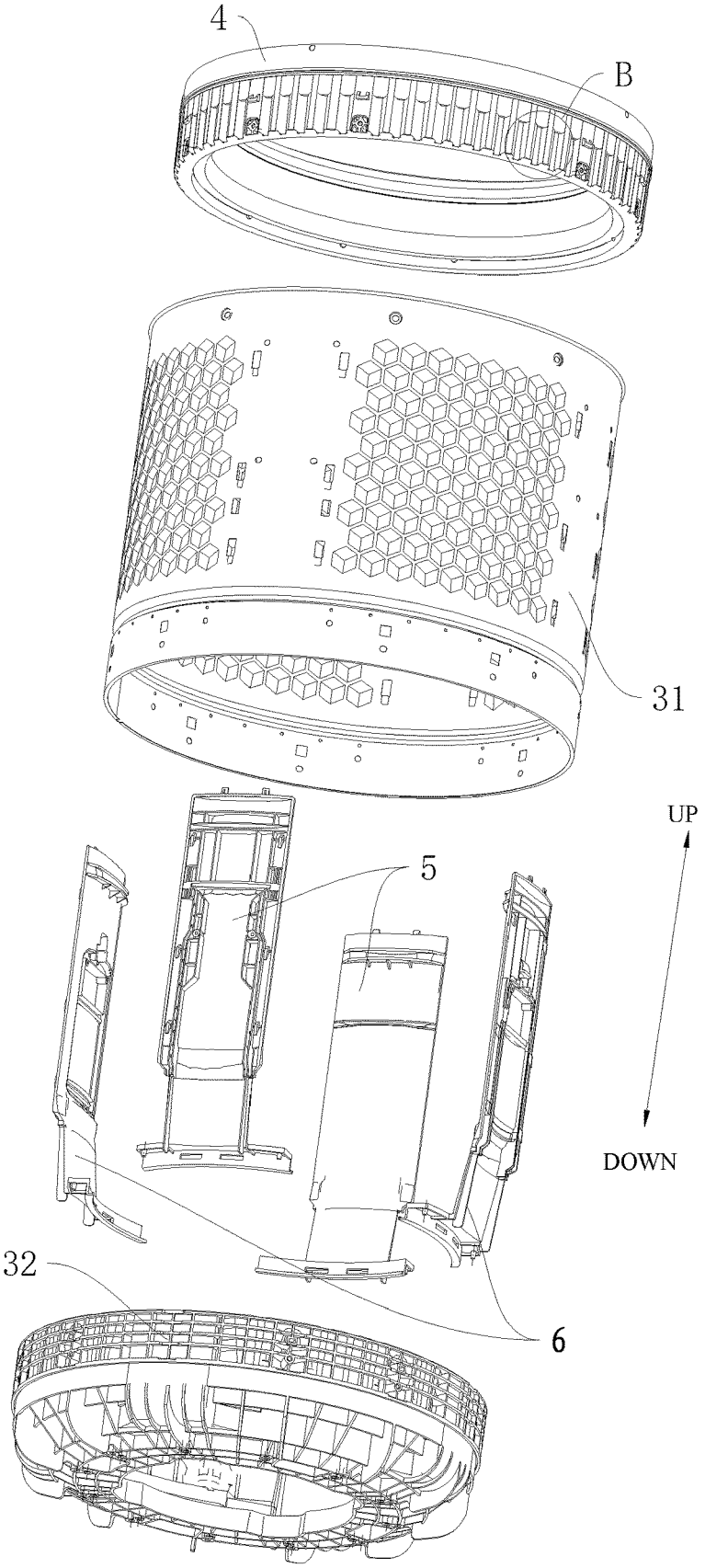
FIG. 4 is an exploded view of a washing tub assembly of a washing machine according to some embodiments of the present disclosure.

As illustrated in FIG. 4, in some embodiments of the present disclosure, the washing tub assembly 3 also includes a tub bottom 32, and after the tub bottom 32 is mounted to the washing tub 31, there are no holes in the visible area inside the washing tub 31 when viewed from inside.

Additionally, the washing tub 31 includes a tub bottom mounting hole 106, and the tub bottom mounting hole 106 is configured to mount to the tub bottom 32.

After the tub bottom 32 has been mounted, the tub bottom mounting hole 106 on the washing tub 31 is covered. In short, after the tub bottom 32 is mounted to the washing tub 31, there are no holes in the visible area inside the washing tub 31 when viewed from inside.

Further, the tub bottom 32 may be made of materials such as a plastic plate or a steel plate, and the washing tub 31 may also be made of materials such as the steel plate. The tub bottom 32 can be mounted to the washing tub 31 by riveting, screw connection, welding or the like, or the tub bottom 32 may be integrally formed with the washing tub 31, depending on variations in material selection of the tub bottom 32 and variations in material selection of the washing tub 31, which can be chosen by those skilled in the art.

As illustrated in FIG. 4, in a specific example of the present disclosure, the washing tub assembly 31 also includes the balance ring 4, and after the balance ring 4 is mounted to the washing tub 31, there are no holes in the visible area inside the washing tub 31 when viewed from inside.

Additionally, the washing tub 31 includes a balance ring mounting hole, and the balance ring mounting hole is configured to mount to the balance ring. After the balance ring 4 has been mounted, the balance ring mounting hole on the washing tub 31 is covered. In short, after the tub bottom 32 is mounted to the washing tub 31, there are no holes in the visible area inside the washing tub 31 when viewed from inside.

Further, the balance ring 4 can be mounted to the washing tub 31 by means of screw connection, riveting, welding and interference fitting.

Figure 6:
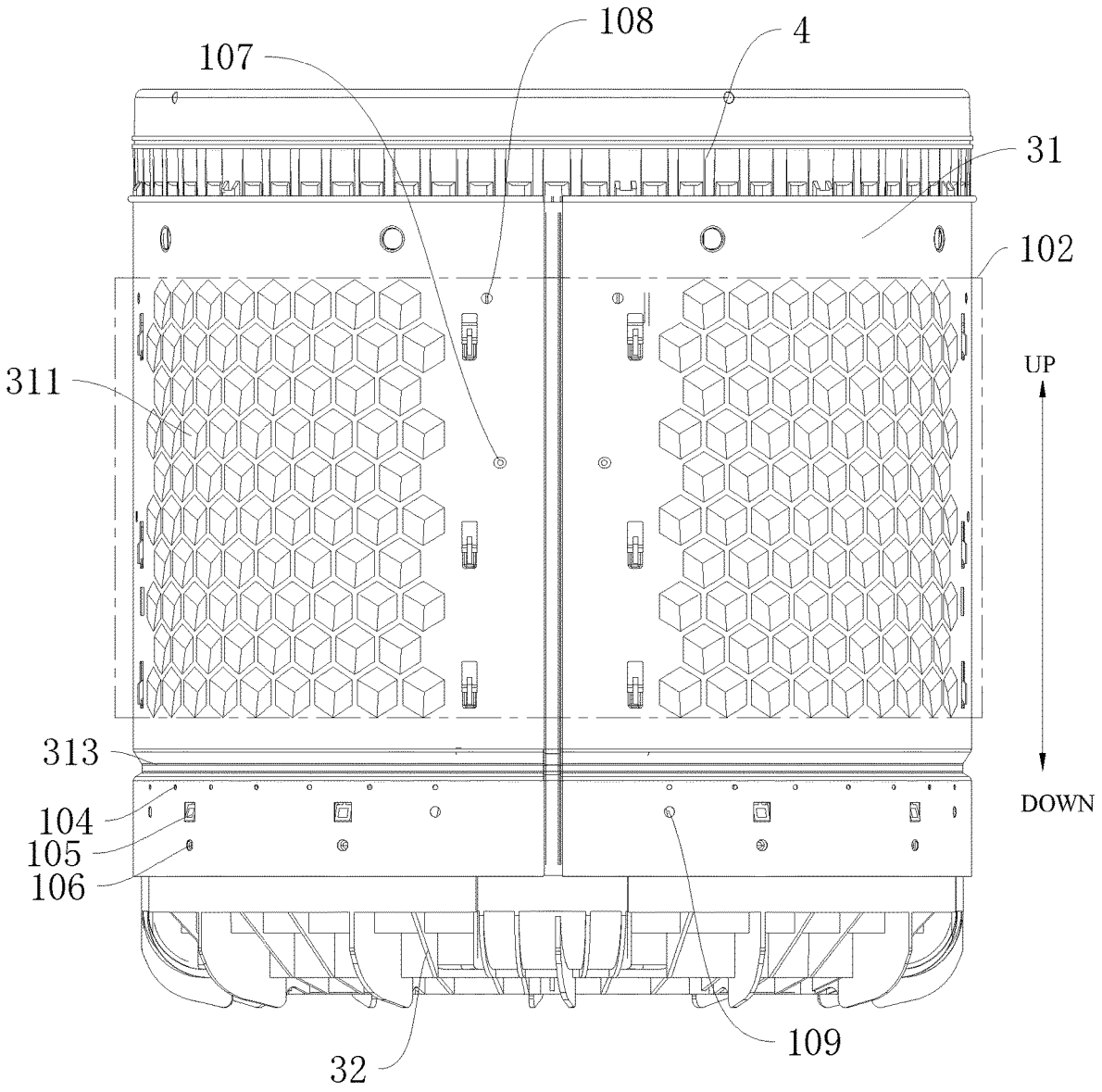
FIG. 6 is a schematic view of a washing machine according to some embodiments of the present disclosure, in which a washing tub is fitted with a balance ring.

As illustrated in FIG. 6, in some embodiments of the present disclosure, the wall of the washing tub 31 defines a water leakage hole 104 configured to discharge the water in the washing tub 31. In some embodiments of the present disclosure, in the dehydration process of the washing machine, the water in the washing tub 31 can be discharged through the water leakage hole 104 to improve a dehydrating effect. The number of water leakage holes 104 is appropriate, such that when the washing machine is dehydrating, a part of the water in the washing tub 31 can be discharged through the water leakage hole 104, so as to further improve a problem of inadequate dehydration.

The water leakage hole 104 is disposed at a lower portion of the washing tub 31. Additionally, a plurality of water leakage holes 104 may be provided.

Specifically, the water leakage hole 104 is defined in the circumferential wall of the washing tub 31 and configured to communicate an interior of the washing tub 31 and an exterior of the washing tub 31, the water leakage hole 104 is located below a central area of the washing tub 31 and adjacent to a lower end of the washing tub 31, and the water leakage hole 104 of the washing tub 31 is covered by a part of the tub bottom 32 fitted in the washing tub 31. After the tub bottom 32 has been assembled, the water leakage hole 104 will not be seen within the visible area of the washing tub 31.

Specifically, the circumferential wall of the washing tub 31 is provided with the water leakage hole 104 communicating the interior of the washing tub 31 and the exterior of the washing tub 31, and the water leakage hole 104 is located below the central area and adjacent to the lower end of the washing tub 31.

Additionally, an upper end of the tub bottom 32 is fitted in the lower end of the washing tub 31, and the water leakage hole 104 of the washing tub 31 is covered by the part of the tub bottom 32 fitted in the washing tub 31.

After the tub bottom 32 is assembled to the washing tub 31, an assembly clearance is present between the tub bottom 32 and the washing tub 31, the water in the washing tub may also be discharged to the exterior of the washing tub via the water leakage hole 104, but the amount of the water discharged via the water leakage hole 104 is small, which is configured to improve the dehydrating effect in the dehydration process.

Additionally, the lower portion of the washing tub 31 has a plurality of water leakage holes 104, and after the tub bottom 32 is mounted to the washing tub 31, the water leakage holes 104 are covered by the tub bottom 32 when viewed from inside.

In some embodiments, referring to FIG. 6, the lower portion of the washing tub 31 is provided with a reinforcing rib 313, and the water leakage hole is disposed below the reinforcing rib.

The reinforcing rib may be in an annular shape extending in a circumferential direction of the washing tub 31, and the reinforcing rib may be a shape protruding outwardly from the washing tub 31 or recessed inwardly towards the washing tub 31. Additionally, the reinforcing rib may also be plate-shaped, block-shaped, or the like. In a specific example of the present disclosure, the reinforcing rib is provided adjacent to a lower edge of the washing tub 31, the reinforcing rib is in the annular shape extending in the circumferential direction of the washing tub 31, and a part of the circumferential wall of the washing tub 31 is recessed inwardly to form the reinforcing rib.

In some embodiments, a plurality of water leakage holes 104 are provided. Specifically, the number of the water leakage holes 104 ranges from 24 to 40. In a preferred embodiment of the present disclosure, the number of the water leakage holes 104 is 28. Certainly, the number and size of the water leakage holes 104 can be selected based on the actual use conditions, for example, 15, 20, 25, 30, 45 or other numbers of water leakage holes 104 may be provided, and an opening size of the water leakage hole may be equivalent to a size of a dehydration hole of a pattern area in a conventional washing tub.

The circumferential wall of the washing tub 31 is provided with the water leakage hole 104, a tub bottom positioning hole 105 configured to position the tub bottom 32, and a tub bottom mounting hole 106 configured to mount to the tub bottom 32; the tub bottom mounting hole 106 and the tub bottom positioning hole 105 are located below the water leakage hole 104 and covered by the part of the tub bottom 32 fitted in the washing tub 31. Therefore, the tub bottom 32 can be conveniently mounted to the washing tub 31.

Additionally, the tub bottom 32 of the present disclosure can be connected to the washing tub 31 by means of welding, bonding or the like, or the tub bottom 32 can also be integrally formed with the washing tub 31.

The water leakage hole 104 can improve the dehydrating effect of the washing machine 100. Further, the upper end of the tub bottom 32 is fitted in the lower end of the washing tub 31, and the water leakage hole 104 of the washing tub 31 is covered by the part of the tub bottom 32 fitted in the washing tub 31. After the washing machine 100 has been assembled, the water leakage hole 104 will not be seen within the visible area of the washing tub 31.

In combination with FIGS. 2, 3 and 6, in some embodiments of the present disclosure, an inner wall of the washing tub 31 is provided with a pattern area 311; an area between a circle passing through an upper edge of the pattern area 311 with a center of the washing tub 31 as a circle center and a circle passing through a lower edge of the pattern area 311 with the center of the washing tub 31 as a circle center is a central area 102 of the washing tub 31. In other words, an area of the washing tub 31 between a plane perpendicular to a central line of the washing tub 31 and passing through the upper edge of the pattern area 311 and a plane perpendicular to the central line of the washing tub 31 and passing through the lower edge of the pattern area 311 is the central area 102.

In a process of rinsing clothes in the washing machine 100, the pattern area 311 will promote friction among the clothes, thereby improving an effect of cleaning clothes. Additionally, this area (i.e. the central area 102) may occupy a relatively large portion of the washing tub 31, and the central area 102 is not provided with the water leakage hole such that the washing water can be adequately gathered in the washing tub during the washing, thereby improving the water-saving effect.

Further, referring to FIG. 6, a plurality of pattern areas 311 are provided and spaced apart from one another in the circumferential direction of the washing tub 31, and each pattern area 311 is arranged in a rectangular shape on the wall of the washing tub 31. Therefore, the clothes cleaning effect is further improved.

Certainly, the clothes cleaning effect of the washing machine 100 can also be improved by other structures, and for example, the washing tub 31 may be provided with protrusions and grooves, or the wall of the washing tub 31 can be configured in a rugged shape.

The pattern area of the washing tub 31 of the present disclosure has no holes.

Figure 5:
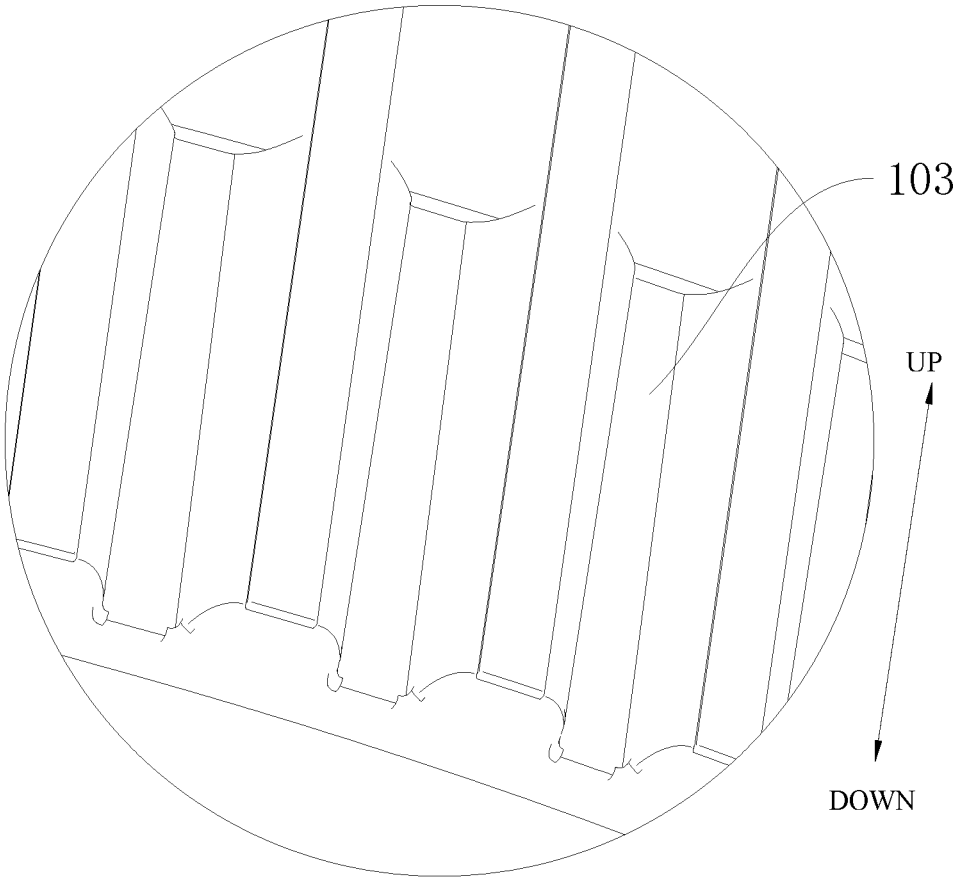
FIG. 5 is a partial enlarged view of part B in FIG. 4.

In combination with FIGS. 4 and 5, in some examples of the present disclosure, an outer wall of the balance ring 4 defines a recess 103 recessed inwardly and extending in an axial direction of the balance ring 4, the recess 103 extends upwardly from a lower end surface of the balance ring 4 beyond an upper end surface of the washing tub 31, and the inner wall of the washing tub 31 and the recess 103 define the water outlet passage 101. The water in the washing tub 31 can enter the water outlet passage 101 via a lower end of the recess 103, and can be discharged out of the washing tub 31 via an upper end of the water outlet passage 101.

Figure 7:
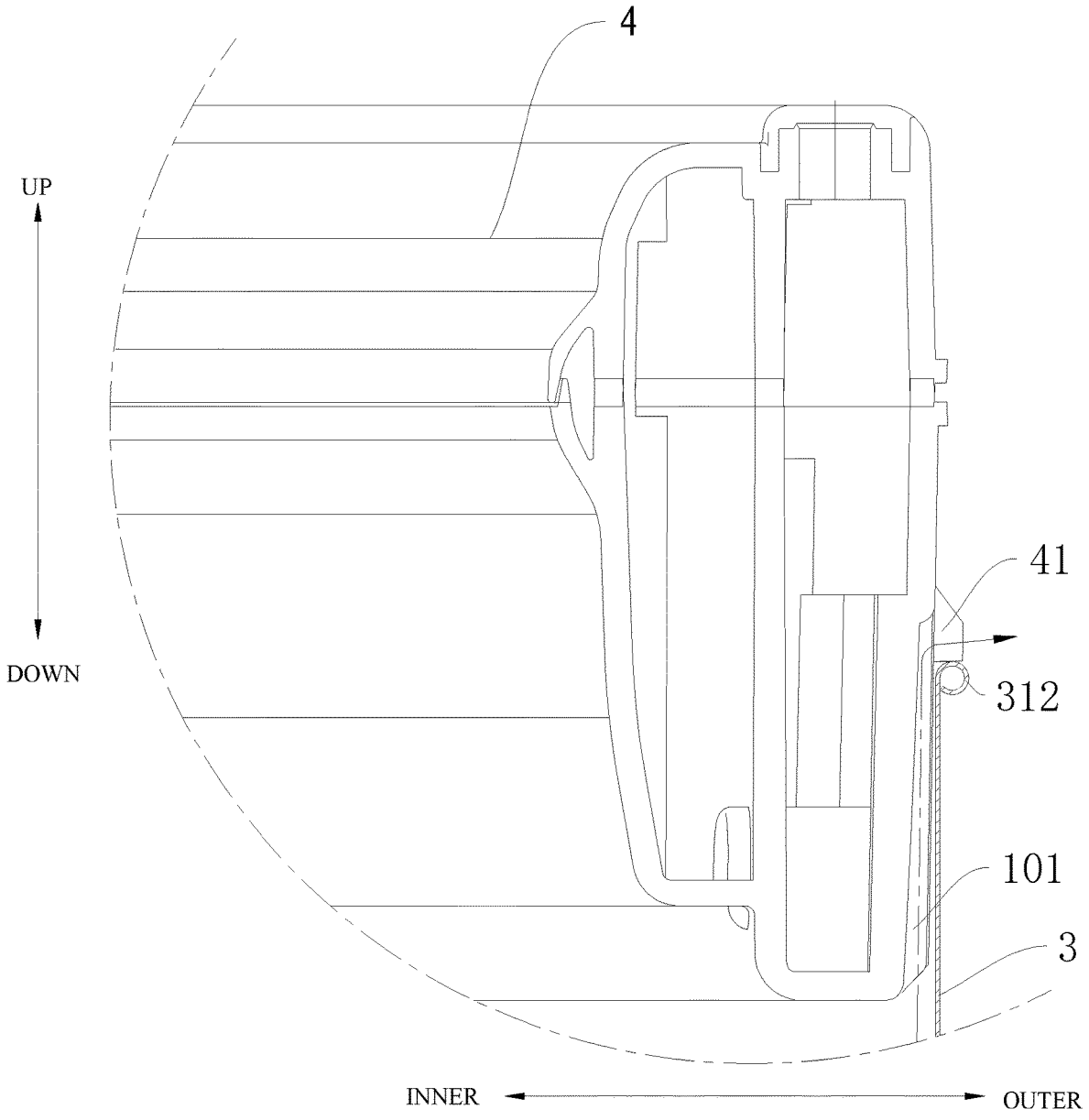
FIG. 7 is a partial sectional view of a washing machine according to some embodiments of the present disclosure, in which a washing tub is fitted with a balance ring, and an arrow shows an effluent water flow direction.

In some embodiments, in combination with FIGS. 4, 5 and 7, a bottom wall of the recess 103 extends obliquely and outwardly in a direction from bottom to top. Accordingly, in the process of the high-speed rotation of the washing tub 31, the water in the washing tub 31 enter the water outlet passage 101, and the water can be conveniently discharged from the washing tub 31, because the bottom wall of the recess 103 extends obliquely and outwardly in the direction from bottom to top, thereby improving dehydration efficiency.

In which, the term "outwardly" means a direction towards the exterior of the washing tub 31.

Additionally, the washing tub 31 may also be provided with a recessed structure that cooperates with the balance ring 4 to define the water outlet passage 101, or may be provided with a combination of those manners that form the water outlet passage 101.

Referring to FIGS. 2 to 7, in a specific example of the present disclosure, a plurality of water outlet passages 101 are provided and arranged in the circumferential direction of the washing tub 31. Thus, the dehydrating effect and dehydration efficiency can be improved.

Additionally, the water outlet passages 101 can be arranged to be evenly spaced in the circumferential direction of the washing tub 31, or the plurality of water outlet passages 101 can be divided into a plurality of portions arranged to be evenly spaced.

Further, referring to FIG. 4, a lower end of the balance ring 4 is connected to the washing tub 31 by a screw, the outer wall of the balance ring 4 is provided with a boss 41, and the boss 41 is supported on the upper end of the washing tub 31. The balance ring 4 can be positioned by the boss 41, avoiding over-constrained positioning of the balance ring 4. Additionally, the balance ring 4 can be fixed by the screw such that stability of a connection between the balance ring and the washing tub 31 can be enhanced.

Further, referring to FIG. 7, the upper end of the washing tub 31 is provided with a flanging 312 folded outwardly to be arc-shaped, and a free end of the flanging 312 abuts against the outer wall of the washing tub 31. The arc-shaped flanging can hide the edge of the washing tub 31, thereby improving safety of the washing machine 100 during assembling and maintenance, and avoiding cutting the balance ring 4 or scraping other parts in the washing machine 100 by the edge of the washing tub 31. Additionally, by providing the arc-shaped flanging 312, structural strength of the washing tub 31 can be enhanced.

Further, in combination with FIG. 6, the wall of the washing tub 31 defines an upper mold positioning hole 108, the upper mold positioning hole 108 is located at an upper portion of the central area 102, and the upper mold positioning hole 108 located at the upper portion of the central area 102 is covered by the cover plate. Specifically, when the washing tub 31 is provided with the water-returning cover plate 5, the upper mold positioning hole 108 located at the upper portion of the central area 102 is covered by the water-returning cover plate 5; when the washing tub 31 is provided with the waterfall-spraying cover plate 6, the mold process positioning hole 108 located at upper portion of the central area 102 is covered by the waterfall-spraying cover plate 6; when the washing tub 31 is provided with the water-returning cover plate 5 and the waterfall-spraying cover plate 6 at the same time, the mold process positioning hole 108 can be covered by at least one of the water-returning cover plate 5 and the waterfall-spraying cover plate 6.

The wall of the washing tub 31 further defines a lower mold positioning hole 109, the lower mold positioning hole 109 is located below the central area 102, and the lower mold positioning hole 109 located below the central area 102 is covered by the tub bottom 32.

The upper mold position hole 108 and the lower mold positioning hole 109 are each used as a mold process positioning hole. The purpose of providing the upper mold positioning hole 108 and the lower mold positioning hole 109 is to facilitate formation of the washing tub 31, and the upper mold positioning hole 108 and the lower mold positioning hole 109 are covered after the mounting is completed, thereby further improving the water-saving effect of the washing machine 100.

In some embodiments of the present disclosure, the washing tub 31 is rotated about a vertical axis 301. That is to say, during operation, the washing tub 31 performs rinsing and dehydrating by rotating about an axis extending in an up-and-down direction.

Further, the washing tub assembly 3 further includes the washing tub 31, and an impeller 7 is disposed at a bottom center of the washing tub assembly 3. In other words, the washing machine of the present disclosure may be an impeller washing machine.

The washing machine 100 according to a specific embodiment of the present disclosure will be described in detail in the following with reference to accompanying drawings In combination with FIGS. 1 to 7, the washing machine 100 according to some embodiments of the present disclosure includes the machine housing 1, the water accommodation tub 2, the washing tub assembly 3, the balance ring 4, the water-returning cover plate 5 and the waterfall-spraying cover plate 6, The washing tub assembly 3 includes the washing tub 31 and the tub bottom 32, the tub bottom 32 is mounted to the lower end of the washing tub 31, the balance ring 4 is mounted to the upper end of the washing tub 3 and has the lower end fitted in the washing tub 31, the balance ring 4 and the washing tub 31 define the water outlet passage 101 therebetween, and the water outlet passage 101 is configured to discharge the water in the washing tub 31. The inner wall of the washing tub 31 is provided with the pattern area 311.

The outer wall of the balance ring 4 defines the recess 103 recessed inwardly and extending in the axial direction of the balance ring 4, the recess 103 extends upwardly from the lower end surface of the balance ring 4 beyond the upper end surface of the washing tub 31, and the inner wall of the washing tub 31 and the recess 103 define the water outlet passage 101. The bottom wall of the recess 103 extends obliquely and outwardly in the direction from bottom to top.

The circumferential wall of the washing tub 31 is provided with the water leakage hole 104 communicating the interior of the washing tub 31 and the exterior of the washing tub 31, and the water leakage hole 104 is located below the central area 102 and adjacent to the lower end of the washing tub 31. The upper end of the tub bottom 32 is fitted in the lower end of the washing tub 31, the water leakage hole 104 of the washing tub 31 is covered by the part of the tub bottom 32 fitted in the washing tub 31, and the water leakage hole 104 may be communicated with the interior of the washing tub 31.

Additionally, the washing tub 31 is also provided with the tub bottom positioning hole 105, the tub bottom mounting hole 106, the cover plate mounting hole 107 and the mold process positioning hole. Those holes are only intended to facilitate the mounting and assembling of the washing tub 31, and the tub bottom positioning hole 105, the tub bottom mounting hole 106, the cover plate mounting hole 107 and the mold process positioning hole are covered after the mounting of the washing tub 31 is completed.

Additionally, there are no holes in the visible area when viewed from inside after the balance ring 4, the cover plate and the tub bottom 32 are mounted to the washing tub 31 of the present disclosure. Specifically, at least a majority of the washing tub 31 does not define any holes, and even the washing tub 31 is provided with a hole structure, the hole structure will be covered after the balance ring 4, the water-returning cover plate 5 and the tub bottom 32 or the like have been mounted. It can be seen that the washing tub 31 of the washing tub assembly 3 of the present disclosure has no holes or only a few holes (which are further covered), thus, in the washing machine having the washing tub assembly 3, the water injected into the washing tub assembly 3 will be retained in the washing tub assembly 3 in the washing process, so as to reduce the amount of the water discharged from the washing tub assembly 3 in the washing process, such that the vast majority of the water injected into the washing tub assembly 3 is used to rinse the clothes, and the water consumption in the process of washing the clothes can be properly reduced, which is water-saving and environment-friendly.

In the washing machine 100 according to some embodiments of the present disclosure, in the washing process, the number of the water leakage holes 104 on the washing tub 31 is appropriate and the water leakage hole 104 is located at a bottom of the washing tub 31, the water in the washing tub 31 is not prone to enter the water accommodation tub 2, and even the water in the washing tub 31 enters between the washing tub 31 and the water accommodation tub 2 via the water leakage hole 104, the water level in the washing tub 31 is considerably higher than the water level between the washing tub 31 and the water accommodation tub 2, thereby achieving the dynamic water saving effect; in the dehydration process, the water in the washing tub 31 is discharged out of the washing tub 31 mainly via the water outlet passage 101, and a small amount of the water is discharged out of the washing tub 31 through the water leakage hole 104, thereby improving the dehydrating effect.

Through the design of the washing tub 31 of the present disclosure, a majority of washing water is retained in the washing tub 31, and only a small amount of water will enter between the washing tub 31 and the water accommodation tub 2, such that the water can be greatly saved, and a water saving rate reaches 40% to 50%.

The washing machine provided with this type of washing tub 31 has the same technical effect described above, and the water in the washing tub 31 is discharged out of the washing machine mainly through the water outlet passage 101 at the top of the washing tub 31.

A method for washing clothes using the washing machine with the new washing tub 31 includes discharging water in the washing tub 31 out of the washing tub 31 mainly through the water outlet passage 101 at the top of the washing tub 31 by means of the high-speed rotation of the washing tub 31, thereby achieving the purpose of dehydration, which can shorten the working time of the washing machine and improve the washing efficiency.

Additionally, the circumferential wall of the bottom of the washing tub 31 defines the water leakage hole 104, such that the dehydrating effect of the washing machine 100 can be improved, that is, the problem of partial inadequate dehydration can be improved.

In the conventional washing machine, a lot of dehydration holes are provided at a pattern zone of the inner tub, the number of the dehydration holes ranges from 160 to 3000, and therefore, when the washing inner tub with dehydration holes at the pattern zone of the conventional washing machine performs washing, the water level in the inner tub and the water level in the outer tub are consistent. However, in the washing process, only the water in the washing tub is used for washing, and since the water level in the inner tub and the water level in the outer tub are consistent, a large amount of washing water is present between the inner tub and the outer tub, which will result in a relatively large waste. However, in the present disclosure, there are no dehydration holes at the pattern area of the washing tub, and even in some embodiments of the present disclosure where the water leakage hole 104 is provided, the number of the water leakage holes 104 ranges from 24 to 40, and preferably the number of the water leakage holes 104 is 28, much smaller than the number of the dehydration holes at the center of the conventional washing tub, such that the water level of the inner tub is higher than the water level of the outer tub during the washing, thereby achieving a good dynamic water saving effect.

Other constitutions and operations of the washing machine according to some embodiments of the present disclosure are well known by those skilled in the art, which will not be described in detail herein.

Reference throughout this specification to "an embodiment," "some embodiments," "an example," "a specific example," or "some examples," means that a particular feature, structure, material, or characteristic described in connection with the embodiment or example is included in at least one embodiment or example of the present disclosure. Thus, the appearances of the phrases in various places throughout this specification are not necessarily referring to the same embodiment or example of the present disclosure. Furthermore, the particular features, structures, materials, or characteristics may be combined in any suitable manner in one or more embodiments or examples. In addition, various embodiments or examples described in the present specification may be combined by those skilled in the art.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. A washing machine, comprising:

a machine housing;

a water accommodation tub disposed in the machine housing; and a washing tub assembly disposed in the water accommodation tub and comprising a cylindrical washing tub having a circumferential wall and a tub bottom;

wherein: an inner wall of the circumferential wall of the washing tub is provided with a pattern area having no holes, the pattern area defines a central region of the washing tub, the central region is formed between (i) a first plane perpendicularly intersecting an upper edge of the pattern area and (ii) a second plane perpendicularly intersecting a lower edge of the pattern area; the circumferential wall of the washing tub is provided with a water leakage hole communicating an interior of the washing tub and an exterior of the washing tub, the water leakage hole is located below the central region, the water leakage hole is covered by the tub bottom after the tub bottom is mounted to the washing tub; the washing tub is provided with a reinforcing rib that is an annular shape extending in a circumferential direction of the washing tub and located below the pattern area of the washing tub that has no holes, the reinforcing rib formed within a recessed portion of the circumferential wall of the washing tub; and the water leakage hole is disposed below the reinforcing rib.

2. The washing machine according to claim 1, further comprising a balance ring mounted to an upper end of the washing tub and having a lower end fitted in the washing tub, the balance ring and the washing tub defining a water outlet passage there between, and the water outlet passage being configured to discharge water in the washing tub.

3. The washing machine according to claim 2, wherein the washing tub assembly comprises at least one cover plate of a water-returning cover plate and a waterfall-spraying cover plate; the washing tub further comprises at least one cover plate mounting hole of a water-returning cover plate mounting hole and a waterfall-spraying cover plate mounting hole, the water-returning cover plate mounting hole is configured to mount to the water-returning cover plate, and the waterfall-spraying cover plate mounting hole is configured to mount to the waterfall-spraying cover plate.

4. The washing machine according to claim 2, wherein the washing tub comprises a tub bottom mounting hole configured to mount to the tub bottom, and a balance ring mounting hole configured to mount to the balance ring.

5. The washing machine according to claim 2, wherein an outer wall of the balance ring defines a recess recessed inwardly and extending in an axial direction of the balance ring, the recess extends upwardly from a lower end surface of the balance ring beyond an upper end surface of the washing tub, and the inner wall of the washing tub and the recess define the water outlet passage.

6. The washing machine according to claim 5, wherein a bottom wall of the recess extends obliquely and outwardly in a direction from bottom to top.

7. The washing machine according to claim 5, wherein a plurality of water outlet passages are provided and arranged in a circumferential direction of the washing tub.

8. The washing machine according to claim 1, wherein an upper end of the tub bottom is fitted in a lower end of the washing tub, and the water leakage hole of the washing tub is covered by a part of the tub bottom fitted in the washing tub.

9. The washing machine according to claim 1, wherein the total number of water leakage holes in the washing tub ranges from 24 to 40.

10. The washing machine according to claim 9, wherein the total number of the water leakage holes in the washing tub is 28.

11. The washing machine according to claim 1, wherein the circumferential wall of the washing tub is provided with a tub bottom positioning hole configured to position the tub bottom, and a tub bottom mounting hole configured to mount to the tub bottom, and the tub bottom mounting hole and the tub bottom positioning hole are located below the water leakage hole and covered by a part of the tub bottom fitted in the washing tub.

12. The washing machine according to claim 1, wherein a wall of the washing tub defines an upper mold positioning hole and a lower mold positioning hole, the upper mold positioning hole is located above the central region of the washing tub, the lower mold positioning hole is located below the central region of the washing tub, the upper mold positioning hole is covered by a cover plate, and the lower mold positioning hole is covered by the tub bottom.

* * * * *